US008814611B2

(12) United States Patent
Onuma et al.

(10) Patent No.: US 8,814,611 B2
(45) Date of Patent: Aug. 26, 2014

(54) CRIMP TERMINAL

(75) Inventors: Masanori Onuma, Makinohara (JP); Kousuke Takemura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 26 days.

(21) Appl. No.: 13/814,098

(22) PCT Filed: Jul. 14, 2011

(86) PCT No.: PCT/JP2011/066103

§ 371 (c)(1),
(2), (4) Date: Feb. 4, 2013

(87) PCT Pub. No.: WO2012/017800

PCT Pub. Date: Feb. 9, 2012

(65) Prior Publication Data

US 2013/0143454 A1 Jun. 6, 2013

(30) Foreign Application Priority Data

Aug. 5, 2010 (JP) ..... 2010-176147

(51) Int. Cl.
*H01R 4/10* (2006.01)

(52) U.S. Cl.
USPC ..... 439/877

(58) Field of Classification Search
USPC ..... 439/877, 882
See application file for complete search history.

(56) References Cited

U.S. PATENT DOCUMENTS

| | | | | |
|---|---|---|---|---|
| 5,316,506 | A | 5/1994 | Ito | |
| 8,177,591 | B2 * | 5/2012 | Okamura et al. | 439/877 |
| 2005/0282445 | A1 * | 12/2005 | Kelly et al. | 439/877 |
| 2006/0068653 | A1 * | 3/2006 | Sakaguchi et al. | 439/877 |

FOREIGN PATENT DOCUMENTS

| | | | |
|---|---|---|---|
| JP | 5-152011 | A | 6/1993 |
| JP | 2009-245695 | A | 10/2009 |
| JP | 2010-027463 | A | 2/2010 |
| JP | 2010-027464 | A | 2/2010 |
| JP | 2010-061870 | A | 3/2010 |

OTHER PUBLICATIONS

European Search Report in corresponding European Patent Application No. 11 81 4430.2, dated Feb. 7, 2014.
International Search Report of PCT/JP2011/066103, dated Aug. 23, 2011.

* cited by examiner

*Primary Examiner* — Phuong Dinh
(74) *Attorney, Agent, or Firm* — Sughrue Mion, PLLC

(57) ABSTRACT

A conductor crimp portion (11) includes, in an inner surface (11R) of the conductor crimp portion (11), circular recesses (20) as serrations of the conductor crimp portion (11) scattered to be spaced from each other. Each of the recesses (20) before crimping has an elliptical shape (oval shape) having a minor axis oriented in a front-rear direction and a major axis oriented in a direction orthogonal to the front-rear direction, to take on a shape close to a perfect circle after crimping.

2 Claims, 9 Drawing Sheets

(a)

(b)

(a)

(b)

(a)

(b)

CRIMP TERMINAL

TECHNICAL FIELD

The present invention relates to an open barrel type crimp terminal having a conductor crimp portion with a U-shaped cross section, which is used in an automotive electric system, for example.

BACKGROUND ART

FIG. 1 is a perspective view showing a configuration of a related crimp terminal described in Patent Document 1, for example.

A crimp terminal 101 includes an electrical connection portion 110 which is to be connected to a terminal of a mating connector in its front portion in a longitudinal direction of the terminal (also in a longitudinal direction of a conductor of an electric wire which is to be connected thereto), includes a conductor crimp portion 111 which is to be crimped around an exposed conductor of an end of the electric wire (not illustrated) behind the electrical connection portion 110, and further includes a coated crimping portion 112 which is to be crimped around an insulation coating portion of the electric wire behind the conductor crimp portion 111. The crimp terminal 101 includes a first joint portion 113, which joins the electrical connection portion 110 and the conductor crimp portion 111 together, between the electrical connection portion 110 and the conductor crimp portion 111, and includes a second joint portion 114, which joins the conductor crimp portion 111 and the coated crimping portion 112 together, between the conductor crimp portion 111 and the coated crimping portion 112.

The conductor crimp portion 111 is formed in a substantially U-shaped cross section from: a bottom plate 111A; and a pair of conductor crimping pieces 111B, 111B which extend upwardly from both right and left side edges of the bottom plate 111A, and which are to be crimped around the conductor of the electric wire disposed on an inner surface of the bottom plate 111A. The coated crimping portion 112 is formed in a substantially U-shaped cross section from: a bottom plate 112A; and a pair of coated crimping pieces 112B, 112B which extend upwardly from both right and left side edges of the bottom plate 112A, and which are to be crimped around the electric wire (a part of the electric wire which is covered with an insulation coating) disposed on an inner surface of the bottom plate 112A.

The first joint portion 113 and the second joint portion 114 which are located in the front side and rear side of the conductor crimp portion 111 are formed in a substantially U-shaped cross section from: bottom plates 113A, 114A; and low side plates 113B, 114B which are erected upwardly from both right and left side edges of the bottom plates 113A, 114A, respectively.

Then, bottom plates ranging from a bottom plate (not illustrated) of the electrical connection portion 110 in the front to the bottom plate of the coated crimping portion 112 in the rearmost (that is to say, the bottom plate 113A of the first joint portion 113, the bottom plate 111A of the conductor crimp portion 111, the bottom plate 114A of the second joint portion 114, and the bottom plate 112A of the coated crimping portion 112) are formed continuously like a single strip-shaped plate. Front and rear ends of the low side plates 113B of the first joint portion 113 continue, respectively, to lower half portions of rear ends of side plates (whose reference numerals are omitted) of the electrical connection portion 110 and front ends of the conductor crimping pieces 111B of the conductor crimp portion 111. Front and rear ends of the low side plates 114B of the second joint portion 114 continue, respectively, to lower half portions of rear ends of the conductor crimping pieces 111B of the conductor crimp portion 111 and front ends of the coated crimping pieces 112B of the coated crimping portion 112.

Multiple recessed groove-shaped serrations 120, which extend in a direction orthogonal to the direction in which the conductor of the electric wire extends (i.e., the longitudinal direction of the terminal), are provided in an inner surface 111R, out of the inner surface 111R and an outer surface 111S of the conductor crimp portion 111, which comes in contact with the conductor of the electric wire.

FIG. 2 is a detailed view of the serrations 120 formed in an inner surface of the conductor crimp portion 111. FIG. 2(*a*) is a plan view showing a development of the conductor crimp portion 111; FIG. 2(*b*) is a cross-sectional view of the serrations 120 taken along a line indicated by arrows IIb-IIb in FIG. 2(*a*); and FIG. 2(*c*) is an enlarged view of a part IIc in FIG. 2(*b*).

The cross-sectional shape of each recessed groove-shaped serration 120 is a rectangular shape or a reversed trapezoidal shape. An inner bottom surface 120A is formed substantially in parallel with the outer surface 111S of the conductor crimp portion 111. Inner corner portions 120C, where the inner bottom surface 120A intersects inner side surfaces 120B, are formed as angular portions where planes intersect each other. Hole edges 120D, where the inner side surfaces 120B intersect the inner surface 111R of the conductor crimp portion 111, are formed as edges.

As shown in FIG. 3, the conductor crimp portion 111 including the serrations 120 is generally manufactured by press working by use of a die 200 (which is practically referred to as a serration die which is to be attached to an upper half of a press die) having raised portions 220 located at positions respectively corresponding to the recessed groove-shaped serrations 120.

As shown in FIG. 4, since the raised portions 220 are linear in shape, the die 200 of this case is manufactured by performing grinding on an upper surface of a block 210 by use of a rotary grinding wheel 250. FIG. 5 shows an outer appearance of the die 200.

To crimp the conductor crimp portion 111 of the crimp terminal 101 configured as described above around a conductor in an end of an electric wire, the crimp terminal 101 is mounted on a mount surface (upper surface) of a lower half die (anvil) which is not illustrated, and the conductor of the electric wire is mounted on an upper surface of the bottom plate 111A while inserted between the conductor crimping pieces 111A of the conductor crimp portion 111. Then, an upper half die (crimper) is lowered relative to the lower half die, and thereby top end sides of the conductor crimping pieces 111B are gradually folded toward the inside thereof by a guide slope of the upper half die.

Subsequently, the upper half die (crimper) is further lowered relative to the lower half die. Finally, the top ends of the conductor crimping pieces 111B are rounded in such a way as to be folded toward the conductor by a curved surface continuous from the guide slope to a central angle portion of the upper half die, the top ends of the conductor crimping pieces 111B dig into the conductor while rubbing against each other, and thereby the conductor crimping pieces 111B are crimped in such a way that the conductor is wrapped by the conductor crimping pieces 111B.

Through the operations described above, the conductor crimp portion 111 of the crimp terminal 101 can be connected to the conductor of the electric wire by compression attachment. As for the coated crimping portion 112, the coated crimping pieces 112B are similarly crimped around an insulation coating portion of the electric wire by gradually bending the coated crimping pieces 112B toward the inside thereof by use of the lower half die and the upper half die. Thereby, the crimp terminal 101 can be electrically and mechanically connected to the electric wire.

When the compression attachment is performed by crimping as described above, the conductor of the electric wire enters the serrations 120 in the inner surface of the conductor crimp portion 111 while deforming plastically due to a pressure force. Thus, the connection between the crimp terminal 101 and the electric wire is strengthened.

CITATION LIST

Patent Literature

Patent Literature 1: Japanese Unexamined Patent Application Publication No. 2009-245695 (FIG. 1)

SUMMARY OF INVENTION

However, sufficient contact conductivity is not necessarily obtained in some cases from the related crimp terminal 101 described above, although the recessed groove-shaped serrations 120 orthogonal to the direction in which the electric wire extends are provided in the inner surface 111R of the conductor crimp portion 111.

Specifically, when the conductor crimp portion 111 is crimped around the conductor of the electric wire, the hole edges of the serrations and a surface of the conductor moved by a pressure force rub against each other, and the inner surfaces of the serrations and the surface of the conductor entering the serrations rub against each other. For this reason, an oxide film on the surface of the conductor is peeled off, and a newly formed surface thus exposed is brought into contact with and conducted with the terminal. In this respect, because the related serrations 120 are linear in shape, the serrations exerts their effectiveness when the conductor of the electric wire moves in a longitudinal direction of the terminal, but little effectiveness when the conductor extends in a direction other than the longitudinal direction. For this reason, sufficiently high contact conductivity is not necessarily obtained in some cases.

Against this background, the present applicant has developed a crimp terminal in which many small circular recesses are provided as serrations in a scattered manner in an inner surface of a conductor crimp portion, in such a state as to be separated from each other. It is considered that the following effects can be obtained from this crimp terminal.

When the conductor crimp portion is crimped around a conductor of an electric wire by use of this crimp terminal, the conductor of the electric wire enters each of the small circular recesses provided as serrations in the inner surface of the conductor crimp portion while deforming plastically. Thus, the connection between the terminal and the conductor can be strengthened. At this time, hole edges of the respective recesses and a surface of the conductor moved by a pressure force rub against each other, and inner side surfaces of the recesses and the surface of the conductor entering the recesses rub against each other. For this reason, an oxide film on the surface of the conductor is peeled off, and a newly formed surface thus exposed is brought into contact with and conducted with the terminal. Moreover, in this crimp terminal, since many small circular recesses are provided in a scattered manner, irrespective of a direction in which the conductor extends, a total length of the hole edges of the recesses exerts effectiveness in scraping the oxide film. Hence, this crimp terminal can enhance the contact conductivity effects due to the exposure of the newly formed surface more than the related crimp terminal provided with the linear serrations which intersect a direction in which the conductor of the electric wire extends.

However, even when many small circular recesses are formed as serrations in the inner surface of the conductor crimp portion, it is found that there is still room for improvement in enhancing contact conductivity between the terminal and the conductor.

Specifically, when the terminal is crimped, the conductor of the electric wire extends in a front-rear direction, and at the same time in the front-rear direction, due to a press pressure force. It is known that extension of the terminal mainly occurs largely at bottom surface portions of the respective small circular recesses. This is because the bottom surface portions of the recesses are thin in thickness. It is found that when the terminal extends as described above, the shape of the recesses deforms into an oval shape long in a front-rear direction even though the recesses before crimping have been each formed in a shape close to a perfect circle in which stiffness is exerted most highly. In this case, a contact pressure onto the conductor by the hole edges of the recesses is reduced, and consequently, contact conductivity between the terminal and the conductor is reduced.

An object of the present invention is to provide a crimp terminal capable of further enhancing contact conductivity with a conductor.

An aspect of the present invention is a crimp terminal including: an electrical connection portion provided in a front portion in a longitudinal direction of the terminal; and a conductor crimp portion provided behind the electrical connection portion and crimped and connected to a conductor of an end of an electric wire, the conductor crimp portion having a cross section formed into a U-shape by a bottom plate and a pair of conductor crimping pieces provided to extend upwardly from both right and left side edges of the bottom plate and crimped to wrap the conductor disposed on an inner surface of the bottom plate, wherein the conductor crimp portion includes, in an inner surface of the conductor crimp portion, recesses as serrations scattered to be spaced from each other, and wherein each of the recesses of the conductor crimp portion before being crimped to the conductor of the end of the electric wire has an oval shape having a minor axis oriented in a front-rear direction and a major axis oriented in a direction orthogonal to the front-rear direction, to take on a shape close to a perfect circle after the conductor crimp portion is crimped to the conductor of the end of the electric wire.

According to the aspect, after the conductor crimp portion is crimped, recesses provided as serrations are each formed into a shape close to a perfect circle which is high in stiffness. For this reason, since stiffness is increased, contact pressure between the conductor and the hole edges of the recesses is increased: as a result, the peeling property of the oxide film of the conductor is promoted; the area of the newly formed surface is increased; and thus contact conductivity between the terminal and the conductor is kept high. In the case of the oval shape unlike the perfect circle shape, the number of arranged recesses can be increased in the front-rear direction because the minor axis sides of the recesses are aligned in the front-rear direction. For this reason, a total length of the hole edges of all the recesses can be increased, which also contributes to an increase in the area of the newly formed surface, thereby enabling an improvement in contact conductivity between the terminal and the conductor.

A ratio of the minor axis to the major axis of the recess may be 1:1.7 to 2.3 before the crimping.

With the configuration described above, a ratio of a minor axis to a major axis of each of the recesses is set at 1:1.7 to 2.3. For this reason, when crimping is performed with application of appropriate pressure, contact conductivity between the terminal and the conductor can be most improved.

BRIEF DESCRIPTION OF DRAWINGS

FIG. 2(*a*) is a developmental plan view thereof; FIG. 2(*b*) is a cross-sectional view of the state taken along a line indicated by arrows IIb-IIb in FIG. 2(*a*); and FIG. 2(*c*) is an enlarged view of a part IIc in FIG. 2(*b*).

FIG. 7(*a*) is a developmental plan view showing a state before crimping; and FIG. 7(*b*) is a cross-sectional view showing a state before crimping and a state after crimping, which are taken along a line indicated by arrows VIIb-VIIb in FIG. 7(*a*).

FIG. 8(*a*) is a developmental plan view showing a state before crimping; and FIG. 8(*b*) is a cross-sectional view showing a state before crimping and a state after crimping, which are taken along a line indicated by arrows VIIIb-VIIIb in FIG. 8(*a*).

FIG. 9(*a*) is a developmental plan view showing a state before crimping; and FIG. 9(*b*) is a cross-sectional view showing a state before crimping and a state after crimping, which are taken along a line indicated by arrows IXb-IXb in FIG. 9(*a*).

FIG. 10(*a*) is a view showing a case of the first embodiment; FIG. 10(*b*) is a view showing a case of the second embodiment; and FIG. 10(*c*) is a view showing a case of the comparative example.

DESCRIPTION OF EMBODIMENTS

Embodiments of the present invention will be described below with reference to the drawings.

Figure 1:
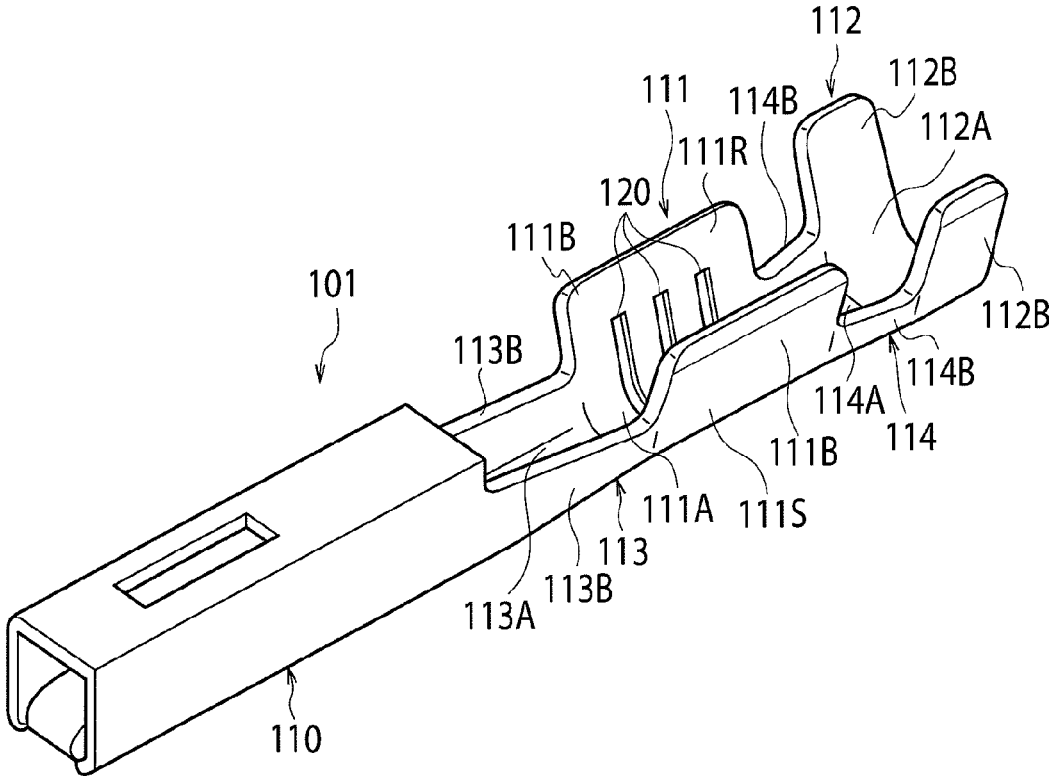
FIG. 1 is perspective view showing a configuration of a related crimp terminal.
Figure 2:
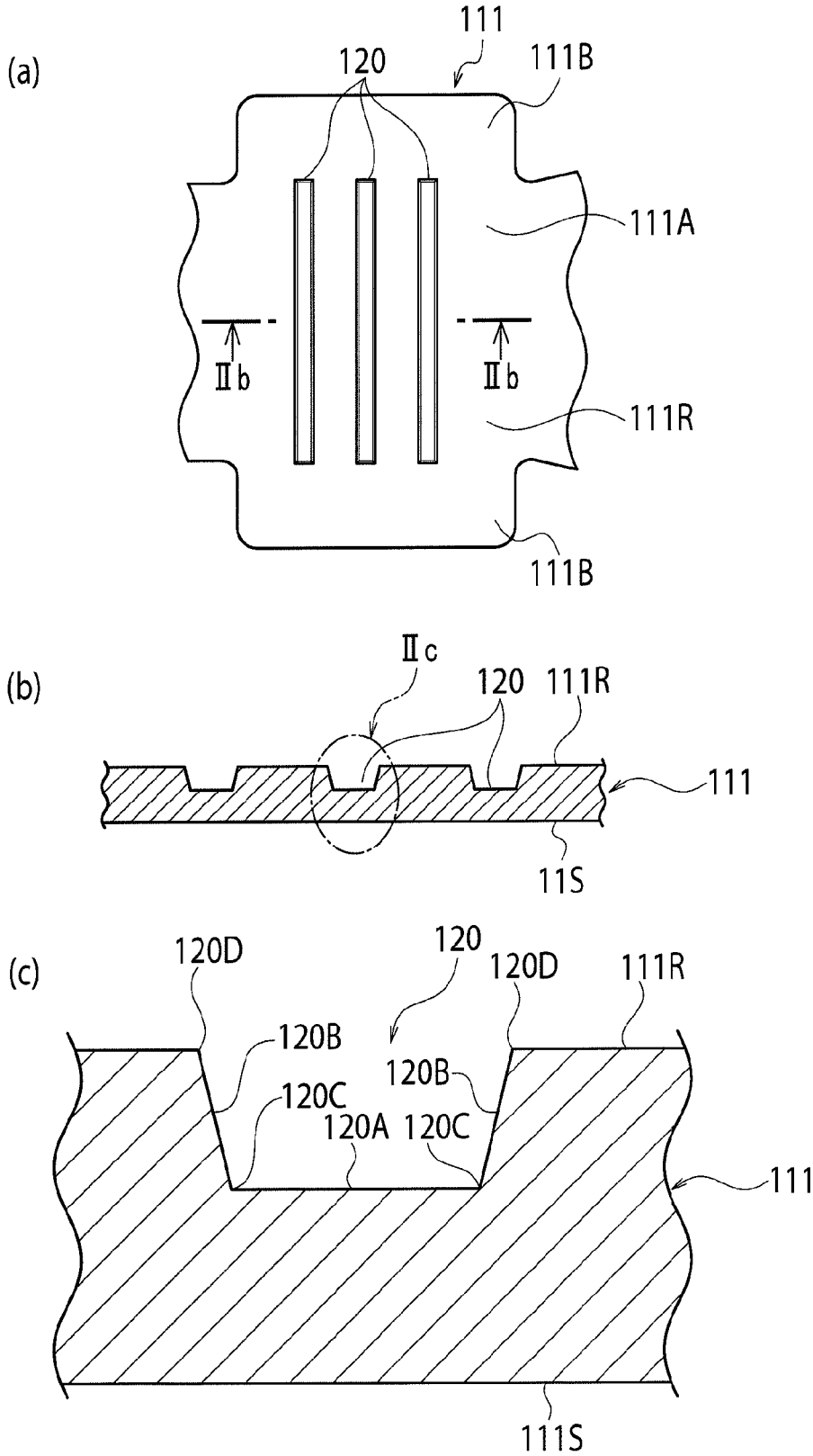
FIG. 2 is a view showing a state before the crimping of a conductor crimp portion of the crimp terminal in FIG. 1.
Figure 3:
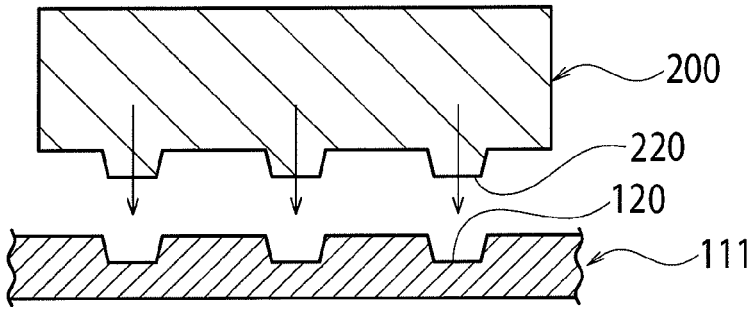
FIG. 3 is a cross-sectional view showing a state where serrations of the crimp terminal in FIG. 1 are subjected to press working.
Figure 4:
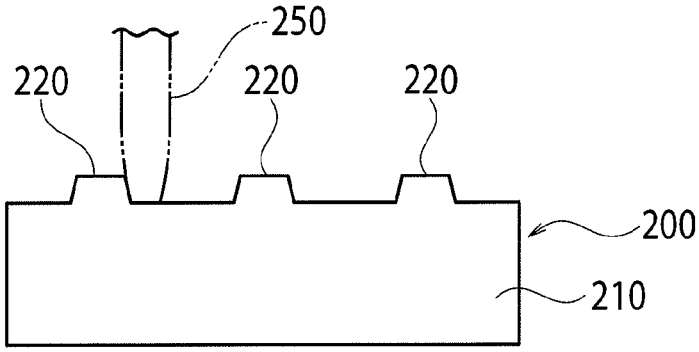
FIG. 4 is a side view showing an appearance where raised portions for serration working are formed by grinding in a press die which is to be used in press working in FIG. 3.
Figure 5:
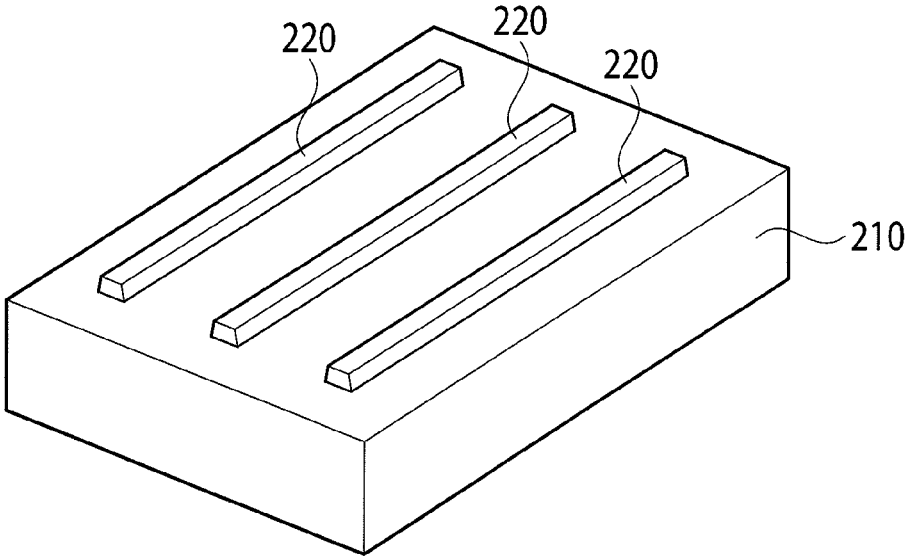
FIG. 5 is a perspective view of an outer appearance of the press die manufactured through the working in FIG. 4.
Figure 7:
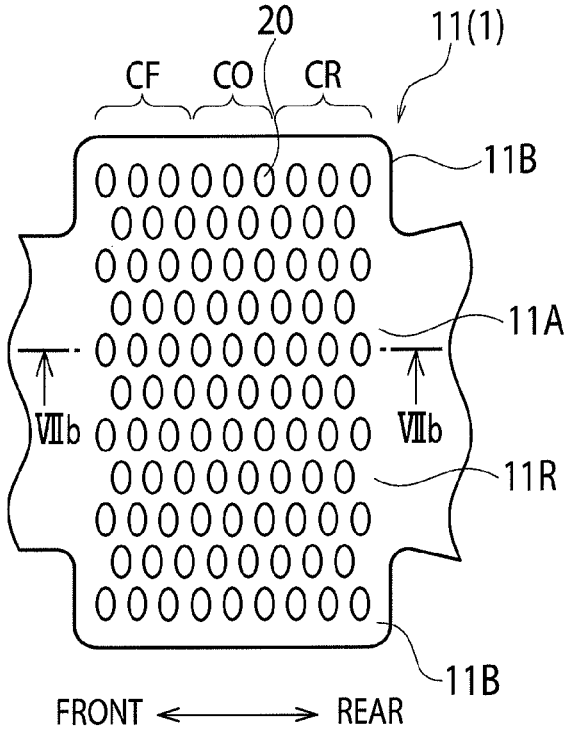
FIG. 7 is a view showing a configuration of a conductor crimp portion of a crimp terminal according to a first embodiment of the present invention.
Figure 7:
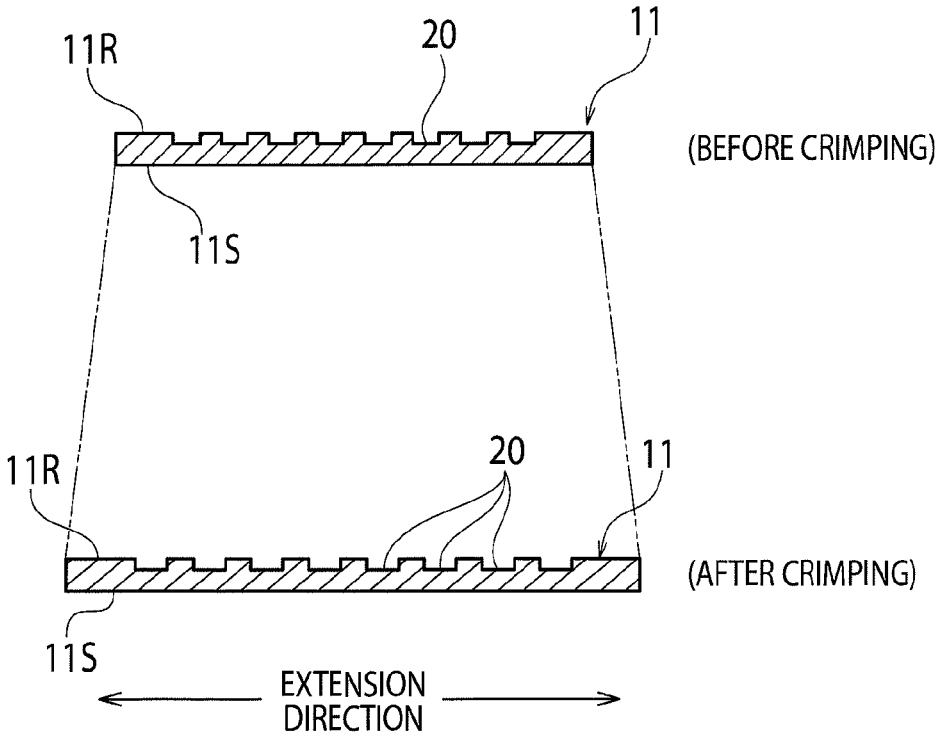
Figure 8:
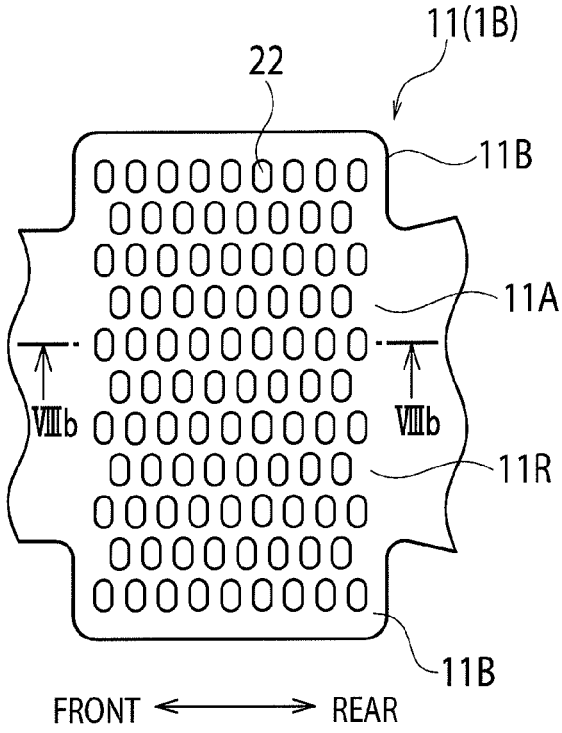
FIG. 8 is a view showing a configuration of a conductor crimp portion of a crimp terminal according to a second embodiment of the present invention.
Figure 8:
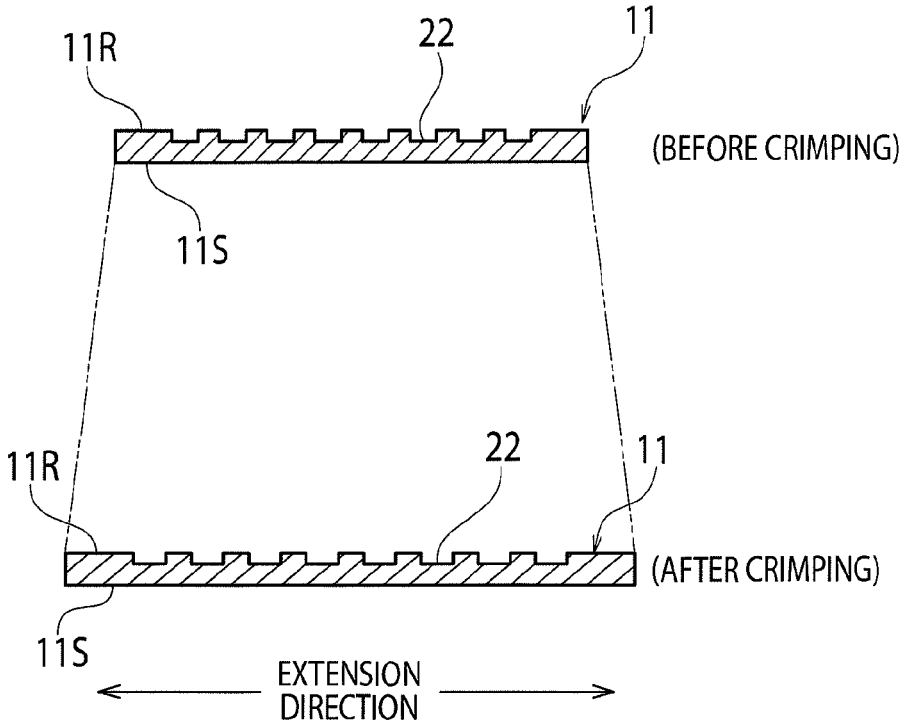
Figure 9:
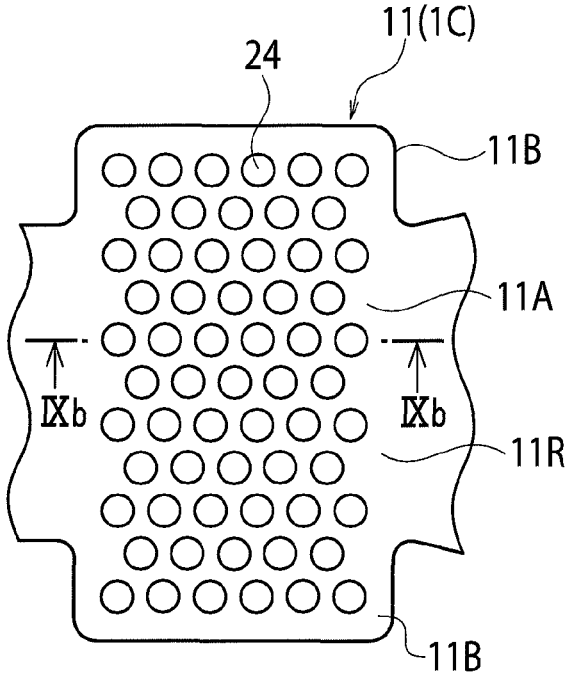
FIG. 9 is a view showing a configuration of a conductor crimp portion of a crimp terminal according to a comparative example to the embodiments of the present invention.
Figure 9:
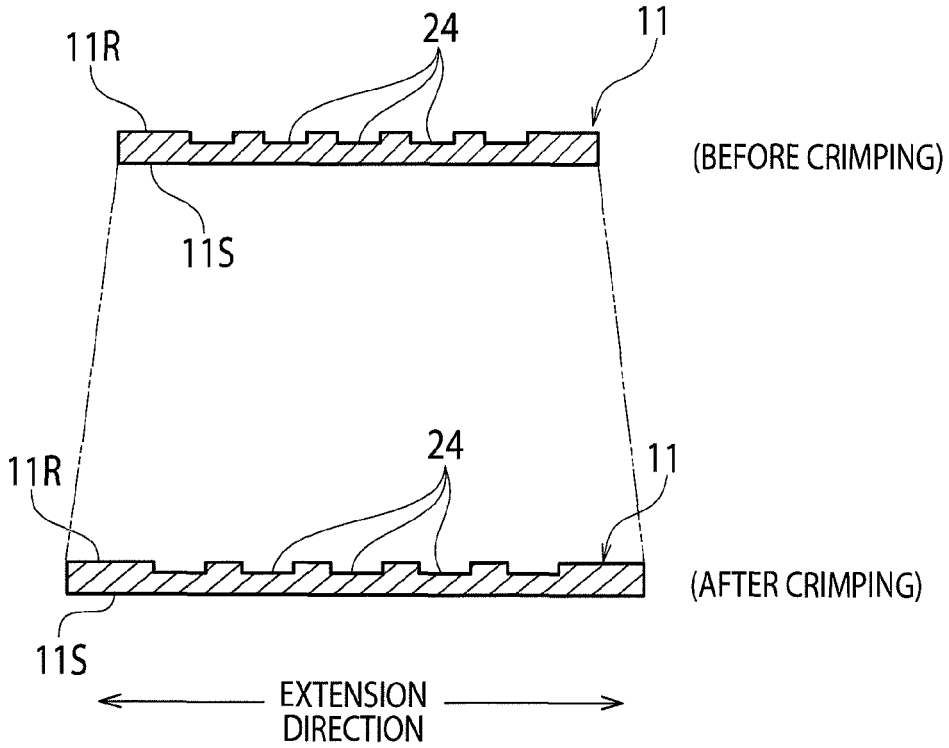

FIG. 5 is a perspective view showing an overall configuration common to crimp terminals according to first and second embodiments of the present invention. FIG. 7 is a view showing a configuration of a conductor crimp portion of the crimp terminal according to the first embodiment of the present invention. FIG. 7(*a*) is a developmental plan view showing a state before crimping; and FIG. 7(*b*) is a cross-sectional view showing a state before crimping and a state after crimping, which are taken along a line indicated by arrows VIIb-VIIb in FIG. 7(*a*). FIG. 8 is a view showing a configuration of a conductor crimp portion of a crimp terminal according to a second embodiment of the present invention. FIG. 8(*a*) is a developmental plan view showing a state before crimping; and FIG. 8(*b*) is a cross-sectional view showing a state before crimping and a state after crimping, which are taken along a line indicated by arrows VIIIb-VIIIb in FIG. 8(*a*). FIG. 9 is a view showing a configuration of a conductor crimp portion of a crimp terminal according to a comparative example to the embodiments of the present invention. FIG. 9(*a*) is a developmental plan view showing a state before crimping; and FIG. 9(*b*) is a cross-sectional view showing a state before crimping and a state after crimping, which are taken along a line indicated by arrows IXb-IXb in FIG. 9(*a*). In each of FIG. 7(*b*), FIG. 8(*b*), and FIG. 9(*b*), an upper side of the sheet shows a cross section before crimping, and a lower side of the sheet shows a cross section after crimping. In each of FIG. 10(*a*) to FIG. 10(*c*), a left side of the sheet shows a shape before crimping, and a right side of the sheet shows a shape after crimping.

Figure 6:
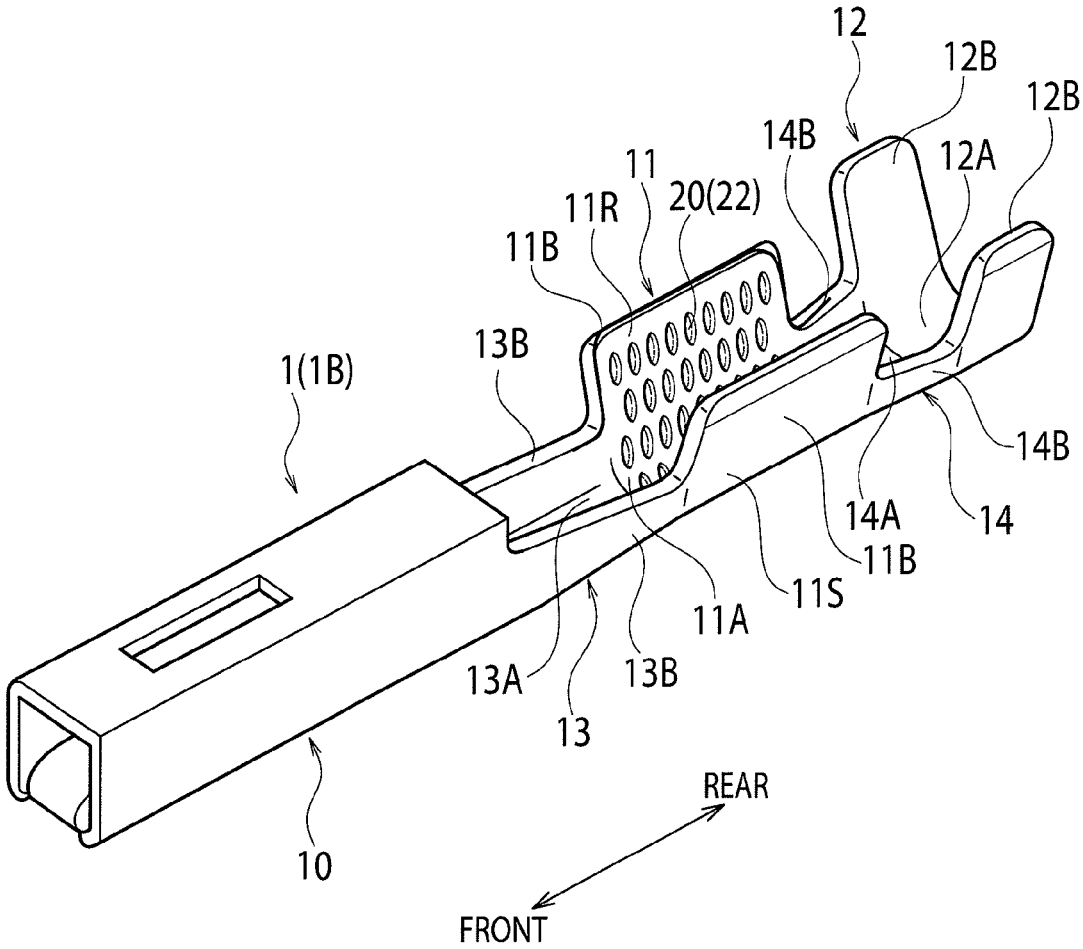
FIG. 6 is a perspective view showing an overall configuration common to crimp terminals according to first and second embodiments of the present invention.

As shown in FIG. 6, each of crimp terminal 1, 1B according to a first or second embodiment is of a female type; includes a box-type electrical connection portion 10, which is to be connected to a male terminal of a mating connector, in a front portion in a longitudinal direction of the terminal (in which is also a longitudinal direction of a conductor of an electric wire to be connected thereto, i.e., a direction in which the electric wire extends); includes a conductor crimp portion 11, which is to be crimped around an exposed conductor Wa (see FIG. 11) of an end of an electric wire W, behind the electrical connection portion 10; and further includes a coated crimping portion 12, which is to be crimped around an insulation coating portion of the electric wire W, behind the conductor crimp portion 11. Each of the crimp terminal 1, 1B includes: a first joint portion 13, which joins the electrical connection portion 10 and the conductor crimp portion 11 together, between the electrical connection portion 10 and the conductor crimp portion 11; and includes a second joint portion 14, which joins the conductor crimp portion 11 and the coated crimping portion 12, between the conductor crimp portion 11 and the coated crimping portion 12.

The conductor crimp portion 11 is formed in a substantially U-shaped cross section from: a bottom plate 11A; and a pair of conductor crimping pieces 11B, 11B which extend upwardly from both right and left side edges of the bottom plate 11A, and which are to be crimped around the conductor Wa of the electric wire W disposed on an inner surface of the bottom plate 11A. The coated crimping portion 12 is formed in a substantially U-shaped cross section from: a bottom plate 12A; and a pair of coated crimping pieces 12B, 12B which extend upwardly from both right and left side edges of the bottom plate 12A, and which are to be crimped around the electric wire (a part of the electric wire which is covered with an insulation coating) disposed on an inner surface of the bottom plate 12A.

The first joint portion 13 and the second joint portion 14 which are located in the front side and rear side of the conductor crimp portion 11 are each formed in a substantially U-shaped cross section from: bottom plates 13A, 14A; and low side plates 13B, 14B which are erected upwardly from both right and left side edges of the bottom plates 13A, 14A, respectively.

Bottom plates ranging from a bottom plate (not illustrated) of the electrical connection portion 10 in the front to the bottom plate of the coated crimping portion 12 in the rearmost (i.e., the bottom plate 13A of the first joint portion 13, the bottom plate 11A of the conductor crimp portion 11, the bottom plate 14A of the second joint portion 14, and the bottom plate 12A of the coated crimping portion 12) are formed continuously like a single strip-shaped plate. Front and rear ends of the low side plates 13B of the first joint portion 13 continue, respectively, to lower half portions of rear ends of side plates (whose reference numerals are omitted) of the electrical connection portion 10 and front ends of the conductor crimping pieces 11B of the conductor crimp portion 11, respectively. Front and rear ends of the low side plates 14B of the second joint portion 14 continue, respectively, to lower half portions of rear ends of the conductor crimping pieces 11B of the conductor crimp portion 11 and front ends of the coated crimping pieces 12B of the coated crimping portion 12, respectively.

As shown in FIG. 7 and FIG. 8, before the conductor crimp portion 11 is crimped around the conductor Wa of the electric wire W, many small circular recesses 20, 22 are provided as recessed serrations in an inner surface 11R, out of the inner surface 11R and an outer surface 11S of the conductor crimp portion 11, which comes in contact with the conductor Wa of the electric wire W. The small circular recesses 20, 22 are provided in a staggered and scattered manner while being separated from each other.

However, as shown in FIG. 7, in the crimp terminal 1 according to the first embodiment, each recess 20 before crimping is formed in an elliptical shape (oval shape) in a posture where a minor axis direction of the recess 20 is oriented in a front-rear direction and a major axis direction thereof is oriented in a direction orthogonal to the front-rear direction, in order to take on a shape close to a perfect circle after crimping.

As shown in FIG. 8, in the crimp terminal 1B according to the second embodiment, each recess 22 before crimping is formed in an edge-rounded rectangular shape (oval shape) in a posture where a minor axis direction of the recess 22 is oriented in a front-rear direction and a major axis direction thereof is oriented in a direction orthogonal to the front-rear direction, in order to take on a shape close to a perfect circle after crimping.

In this case, a ratio of a minor axis to a major axis of each of the oval-shaped recesses 20, 22 is set at 1:1.7 to 2.3.

On the other hand, as shown in FIG. 9, each of recesses 24 before crimping is formed in a perfect circle shape in a crimp terminal 1C of the comparative example.

Figure 11:
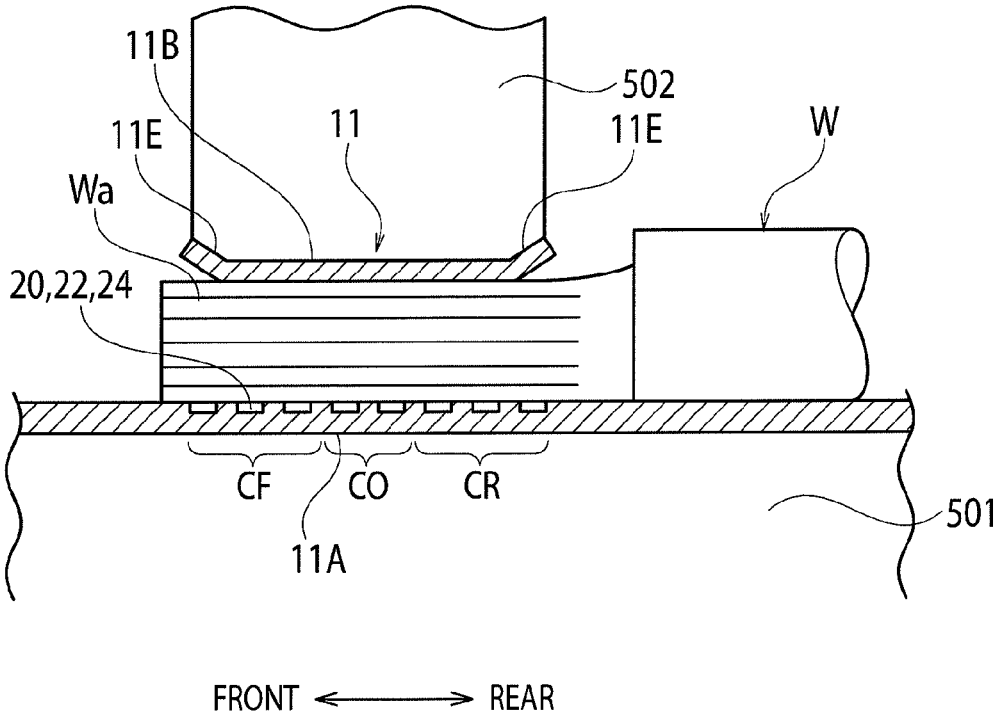
FIG. 11 is a vertical cross-sectional view showing a portion where the conductor crimp portion is crimped around a conductor of an electric wire.

In order to crimp the conductor crimp portion 11 of each of these crimp terminals 1, 1B, 1C around the conductor of an end of the electric wire, each crimp terminal 1, 1B, 1C is mounted on a mount surface (upper surface) of a lower half die (anvil) 501, and the conductor Wa of an end of the electric wire W is mounted on an upper surface (inner surface 11R) of the bottom plate 11A while inserted between the conductor crimping pieces 11B of the conductor crimp portion 11, as shown in FIG. 11. Then, an upper half die (crimper) 502 is lowered relative to the lower half die, and thereby top end sides of the conductor crimping pieces 11B are gradually folded toward the inside thereof by a guide slope of the upper half die.

Subsequently, the upper half die 502 is further lowered relative to the lower half die 501. Finally, the top ends of the conductor crimping pieces 11B are rounded in such a way as to be folded toward the conductor by a curved surface continuous from the guide slope to a central angle portion of the upper half die 502; the top ends of the conductor crimping pieces 11B dig into the conductor Wa while rubbing against each other; and thereby the conductor crimping pieces 11B are crimped in such a way that the conductor Wa is wrapped by the conductor crimping pieces 11B. In this crimping, a tapered portion called a bell mouth 11E is produced to mitigate damage to the conductor Wa at both ends in the front-rear direction of the conductor crimp portion 11.

Through operations as described above, the conductor crimp portion 11 of each of the crimp terminal 1, 1B, 1C can be connected to the conductor Wa of the electric wire W by crimping. As for the coated crimping portion 12, the coated crimping pieces 12B are similarly crimped around an insulation coating portion of the electric wire W by gradually bending the coated crimping pieces 12B toward the inside thereof by use of the lower half die and the upper half die. Thereby, the crimp terminal 1 can be electrically and mechanically connected to the electric wire W.

The following effects can be obtained from the crimp terminals 1, 1B of the first embodiment and second embodiment.

When the conductor crimp portion 11 is crimped around the conductor Wa of the electric wire W by use of each of the crimp terminals 1, 1B, the conductor Wa of the electric wire W enters the inside of the corresponding ones of the small circular recesses 20, 22 provided as serrations in the inner surface 11R of the conductor crimp portion 11 while deforming plastically. Thus, the connection between each of the crimp terminals 1, 1B and the conductor Wa can be strengthened. At this time, hole edges 20D, 22D of the recesses 20, 22 and a surface of the conductor Wa moved by a pressure force rub against each other, and inner side surfaces 20B, 22B of the recesses 20, 22 and the surface of the conductor Wa entering the recesses 20, 22 rub against each other, respectively. For this reason, an oxide film on the surface of the conductor Wa is peeled off, and a newly formed surface thus exposed is brought into contact with and conducted with the crimp terminal 1, 1B.

In particular, in the crimp terminal 1, 1B, many small circular recesses 20, 22 are provided as serrations, respectively. For this reason, irrespective of a direction in which the conductor Wa extends, a total length of the hole edges 20D, 22D of the recesses 20, 22 exerts effectiveness in scraping the oxide film, respectively. Hence, contact conductivity effects due to the exposure of the newly formed surface can be enhanced more than those in the related example where linear serrations are provided to intersect a direction in which the conductor Wa of the electric wire W extends.

Figure 10:
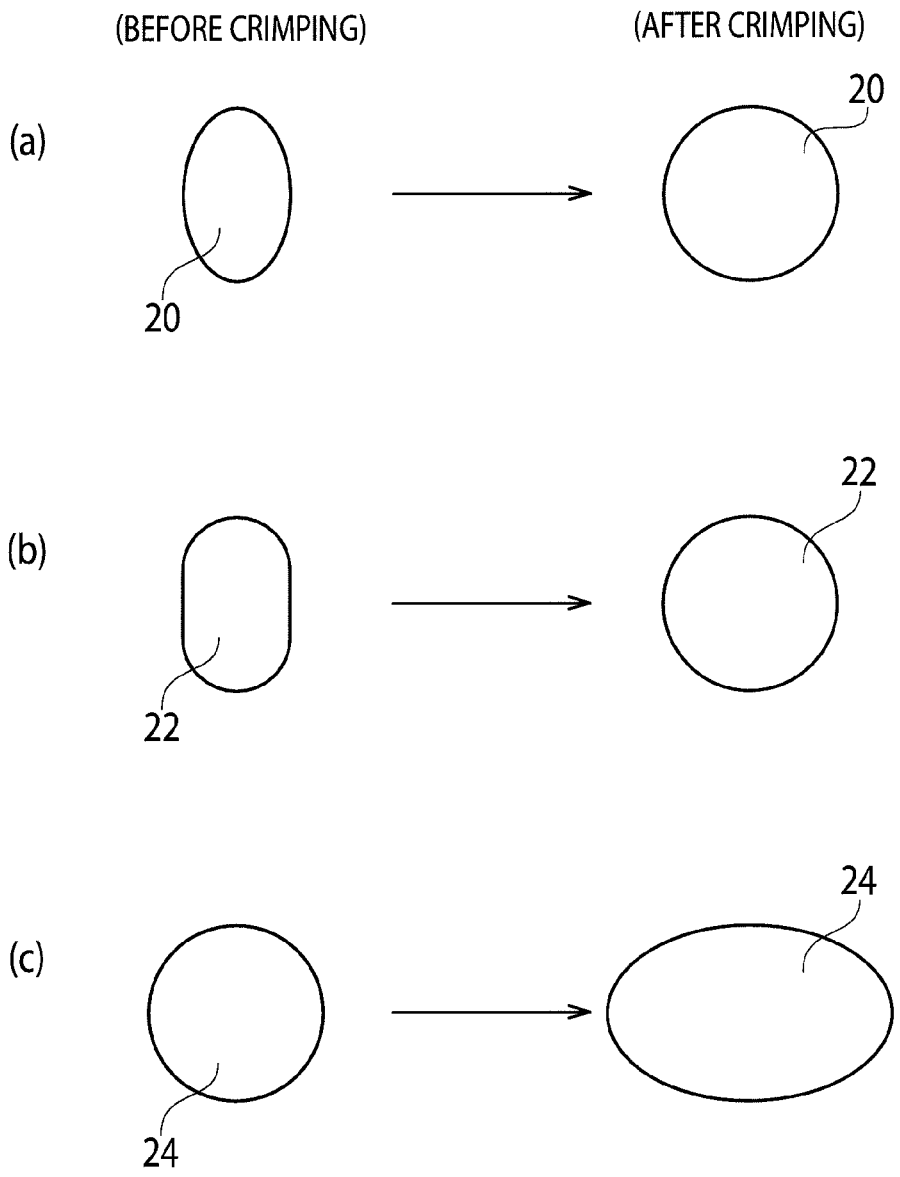
FIG. 10 is a cross-sectional view showing a difference between a shape before crimping and a shape after crimping of a small circular recess provided as a serration.

As shown in FIG. 10(*a*) and FIG. 10(*b*), after the conductor crimp portion 11 is crimped around the conductor Wa of the electric wire W, the recesses 20, 22 provided as serrations are each deformed into a shape close to a perfect circle which is high in stiffness. For this reason, since stiffness is increased, a contact pressure between the conductor Wa and the hole edges of the recesses 20, 22 is increased; as a result, the peeling property of the oxide film of the conductor Wa is promoted; the area of the newly formed surface is increased; and thus contact conductivity between each of the crimp terminals 1, 1B and the conductor Wa is kept high. In particular, the ratio of the minor axis to the major axis of each of the oval-shaped recesses 20, 22 is set at 1:1.7 to 2.3. For this reason, when the crimping is performed with application of appropriate pressure, contact conductivity between the crimp terminal 1 and the conductor Wa can be most improved.

In the case of the oval shape unlike the perfect circle shape, as can be understood from comparison among FIG. 7(*a*), FIG. 8(*a*) and FIG. 9(*a*), the number of arranged recesses 20, 22 can be increased in the front-rear direction because the minor axis sides of the recesses 20, 22 are aligned in the front-rear direction. For this reason, a total length of the hole edges of all the recesses 20, 22 can be increased, which also contributes to an increase in the area of the newly formed surface, thereby enabling an improvement in contact conductivity between the crimp terminal 1, 1B and the conductor Wa.

When the conductor crimp portion 11 is crimped around the conductor Wa of the electric wire W, the conductor Wa or the conductor crimp portion 11 do not extend very much in a central portion CO but extend greatly in regions CF, CR on both sides of the central portion CO as shown in FIG. 11. For this reason, only the recesses 20, 22 arranged in the regions CF, CR may be each formed in an oval shape.

In the above embodiments, each of the crimp terminals 1, 1B is a female crimp fitting including the box-type electrical connection portion 10. However, the present invention is not limited to this. A male crimp fitting including a male tab may be used, or a so-called LA terminal in which a penetration hole is formed in a metal plate may be used, and a crimp terminal in any shape may be used as needed.

Although the embodiments of the present invention are described above, the present invention is not limited to the embodiments, and various modifications can be made.

The invention claimed is:

1. A crimp terminal comprising:

an electrical connection portion provided in a front portion in a longitudinal direction of the terminal; and a conductor crimp portion provided behind the electrical connection portion and crimped and connected to a conductor of an end of an electric wire, the conductor crimp portion having a cross section formed into a U-shape by a bottom plate and a pair of conductor crimping pieces provided to extend upwardly from both right and left side edges of the bottom plate and crimped to wrap the conductor disposed on an inner surface of the bottom plate, wherein the conductor crimp portion includes, in an inner surface of the conductor crimp portion, recesses as serrations scattered to be spaced from each other, and wherein each of the recesses of the conductor crimp portion before being crimped to the conductor of the end of the electric wire has an oval shape having a minor axis oriented in a front-rear direction and a major axis oriented in a direction orthogonal to the front-rear direction, to take on a shape close to a perfect circle after the conductor crimp portion is crimped to the conductor of the end of the electric wire.

2. The crimp terminal according to claim 1, wherein a ratio of the minor axis to the major axis of the recess is 1:1.7 to 2.3 before the crimping.

* * * * *